US005467323A

United States Patent [19]

Sone

[11] Patent Number: 5,467,323

[45] Date of Patent: Nov. 14, 1995

[54] ELECTROACOUSTIC TRANSDUCER

[75] Inventor: Takahiro Sone, Shizuoka, Japan

[73] Assignee: Star Micronics Co., Ltd., Shizuoka, Japan

[21] Appl. No.: 235,794

[22] Filed: Apr. 29, 1994

[30] Foreign Application Priority Data

May 4, 1993 [JP] Japan ..... 5-128486

[51] Int. Cl.[6] ..... G08B 3/00

[52] U.S. Cl. ..... 367/175; 340/391.1; 340/388.4; 381/193

[58] Field of Search ..... 381/193, 203, 381/190; 340/391.1, 388.4, 384.73; 367/175

[56] References Cited

U.S. PATENT DOCUMENTS 4,160,132 7/1979 Rae et al. ..... 340/391.1
4,163,223 7/1979 Sato et al. ..... 340/388.1
4,251,807 2/1981 Hofer et al. ..... 340/391.1
5,416,751 5/1995 Imahori et al. ..... 367/175

FOREIGN PATENT DOCUMENTS 289264 2/1988 European Pat. Off. ..... 340/391.1
2645159 4/1977 Germany ..... 340/391.1

*Primary Examiner*—Charles T. Jordan
*Assistant Examiner*—Christopher K. Montgomery
*Attorney, Agent, or Firm*—Pollock, Vande Sande & Priddy

[57] ABSTRACT

In an electroacoustic transducer, the opening portion of a casing body which contains therein a magnetic driving portion for converting an electric signal into a sound is closed by a casing cap to form a resonance space (resonance chamber) which resonates in response to an acoustic vibration generated by the magnetic driving portion, wherein a plurality of slender projections to be entered into said casing body are projected from the casing cap to position said casing cap relative to said casing body. As a result, it is possible to enlarge the capacity of the resonance chamber and improve the assembling accuracy.

4 Claims, 5 Drawing Sheets

ELECTROACOUSTIC TRANSDUCER

BACKGROUND OF THE INVENTION

1. Field of the Invention

The present invention relates to an electroacoustic transducer used in a buzzer etc. for converting an electric signal supplied thereto into a sound.

2. Description of the Related Art

A conventional electroacoustic transducer is provided with a housing 102 formed of synthetic resin as illustrated in FIG. 5. The housing 102 is dividedly composed of a casing body 102A and a casing cap 102B. The casing body 102A is a cylindrical body having openings at both ends thereof while the casing cap 102B is a short cylindrical body which is closed at the ceiling surface thereof. Such a construction is required by the inner structure of the electroacoustic transducer and the facility of assembly thereof.

The casing body 102A accommodates a magnetic driving portion 104 as a means for converting an electric signal into an oscillating magnetic field. The magnetic driving portion 104 comprises a magnetic core 106 having a pillar shape at the central portion thereof and a coil 108 wound around the magnetic core 106. The coil 108 is energized by an alternating current supplied through an input terminal by an external device. The magnetic core 106 is surrounded by an annular magnet 110 which generates a bias magnetic field.

A stepped supporting portion 112 is formed on the inner side of the upper opening portion of the casing body 102A to support a diaphragm 114. Since the diaphragm 114 is composed of a thin elastic magnetic member which is attracted and magnetized by the annular magnet 110, the circumferential edge of the diaphragm 114 is held by the stepped supporting portion 112 and a closed magnetic path is formed between the magnetic core 106 and the annular magnet 110. A magnetic piece 116 is attached to the central portion of the diaphragm 114 to add mass thereto and increase magnetic flux density.

The casing body 102A is closed by the casing cap 102B at the side of the upper opening portion thereof to form a resonance chamber 118 serving as a resonance space and a sound emitting cylinder 120 is formed in the ceiling portion of the casing cap 102B to allow the resonance chamber 118 to be open to the atmosphere. A sound emitting hole 122 in the sound emitting cylinder 120 is a means for emitting the resonant vibration of the resonance chamber 118 to the atmosphere.

As to assembling the housing 102 of such an electroacoustic transducer, a stepped portion 124 is provided at the lower portion of the casing cap 102B to form a small diameter portion 126 which is smaller in outer diameter than that of the casing cap 102B with the casing cap 102B being designed to have the same outer diameter as that of the casing body 102A. The small diameter portion 126 is inserted into the casing body 102A until the stepped portion 124 is brought into close contact with the edge surface of the casing body 102A. The stepped portion 124 is indispensable for high sealing performance of the structure in joining the casing cap 102B to the casing body 102A by way of ultrasonic welding etc. A minute gap 128 is formed between the end surface of the opening portion of the small diameter portion 126 of the casing cap 102B and the stepped supporting portion 112 of the casing body 102A to restrain the edge of the diaphragm 114 therein. That is, the diaphragm 114 is restrained in the upper limit of movement by the casing cap 102B so as to be prevented from getting out of position or being deformed even if a strong shock is given thereto.

In such an electroacoustic transducer as set forth above, the capacity of the resonance chamber 118 is a main factor for realizing a necessary sound characteristic. Moreover, it is necessary to divide the housing 102 into the casing body 102A and the casing cap 102B for the inner structure of the electroacoustic transducer or for the facility of assembly thereof. And in case the casing body 102A and the casing cap 102B are integrated into the housing 102, it is necessary to take a measure to improve the external accuracy of the housing 102 and the positional accuracy of the diaphragm 114. A small-sized electroacoustic transducer is usually about 10 mm in diameter, and when the casing body 102A and casing cap 102B are joined each other poorly in accuracy, i.e., there occurs a discrepancy therebetween, it causes the deterioration of external appearance of the housing 102 and in some cases the product becomes unqualified merchandise.

Accordingly, in a conventional electroacoustic transducer, the casing cap 102B is made thick so as to facilitate positioning the same relative to the casing body 102A and prevent the diaphragm 114 from getting out of position. Such a structure, however, reduces the volume ratio of the resonance chamber 118 to the whole capacity or volume of the housing 102, so that the sound characteristic is deteriorated and the miniaturization or flattening of the housing 102 and consequently the miniaturization of the electroacoustic transducer is prevented.

SUMMARY OF THE INVENTION

Accordingly, it is the object of the present invention to provide an electroacoustic transducer enlarged in the capacity of the resonance chamber therein and improved in assembling accuracy.

The electroacoustic transducer according to the present invention and shown in FIG. 1, comprises a magnetic driving portion (4) for converting an electric signal into an oscillating magnetic field, a diaphragm (14) which is vibrated by the oscillating magnetic field converted by the magnetic driving portion (4), a casing body (2A) which supports the diaphragm (14) and accommodates therein the magnetic driving portion (4) at the rear side of the diaphragm (14), and a casing cap (2B) which closes the opening portion (5) of the casing body (2A) and forms a resonance space at the front side of the diaphragm (14). The invention is characterized by a plurality of projections (48) formed in the casing cap (2B), projecting into the opening portion of the casing body (2A) to position the casing cap (2B) relative to the casing body (2A).

With the arrangement described above, the casing cap is automatically positioned relative to the casing body by entering a plurality of projections which project from the inside of the casing cap into the casing body of the electroacoustic transducer according to the present invention. This positioning improves the joining accuracy between the casing body and casing cap, facilitates assembling and enhances the external accuracy and quality of the product.

Since the projections are means for positioning the casing cap relative to the casing body, each projection can be sufficiently slender to perform the function. As a result, the occupation ratio of the projections to the capacity of the resonance chamber is small so that the capacity of the resonance chamber can be set more freely. In other words, the capacity of the resonance chamber can be made large at need. In case of the housing having the same capacity of that of a conventional electroacoustic transducer, the capacity of the resonance chamber can be made larger in the present invention. In case of the resonance chamber having the same capacity as that of the conventional one, the housing can be made flattened. Since the sound emitting hole can be made large as the resonance chamber is enlarged, the large sound emitting hole contributes to the improvement of the sound characteristic of the electroacoustic transducer such as reinforcement of sound pressure etc. being coupled with the enlarged capacity of the resonance chamber.

Moreover in the electroacoustic transducer according to the present invention, projections formed in the casing cap enter the casing body so as to function as a stopper for the diaphragm. When a violent shock or vibration is applied to the electroacoustic transducer, the end surfaces of the projections prevent the diaphragm from moving excessively thus being deformed.

Still furthermore, since the projections are arranged at a given interval and the end surfaces thereof are in parallel to the diaphragm, the diaphragm is restrained in moving as it strikes against the projections so that it is possible to prevent the local deformation etc. of the diaphragm when it strikes against the projections. It contributes to the improvement of reliability of the electroacoustic transducer.

The electroacoustic transducer according to the present invention has the following characteristics.

a. It is possible to set the capacity of the resonance chamber more freely for improving the sound characteristic thereof.

b. It is possible to easily position the casing cap relative to the casing body so as to simplify the positioning operation thereof and improve the external appearance and the production efficiency.

c. It is possible to restrain the range of movement of the diaphragm by way of the projections so as to prevent the diaphragm from floating off the supporting edge portion, from being damaged or broken due to excessive movement and consequently from being reduced in reliability or deteriorated in the characteristic of the electroacoustic transducer in manufacturing, using or transporting the same.

The objects and characteristics of the present invention will be disclosed more in detail in the following embodiments.

DESCRIPTION OF THE PREFERRED EMBODIMENT

The present invention will be described in detail exemplifying an embodiment illustrated in attached drawings.

Figure 1:
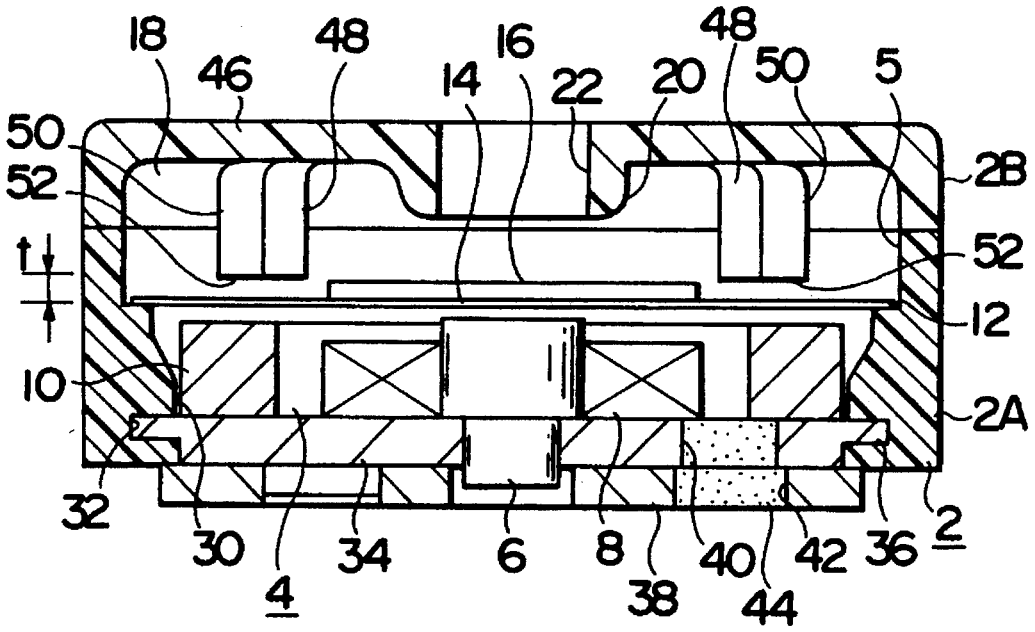
FIG. 1 is a longitudinal cross-sectional view of an electroacoustic transducer according to an embodiment of the present invention.
Figure 2:
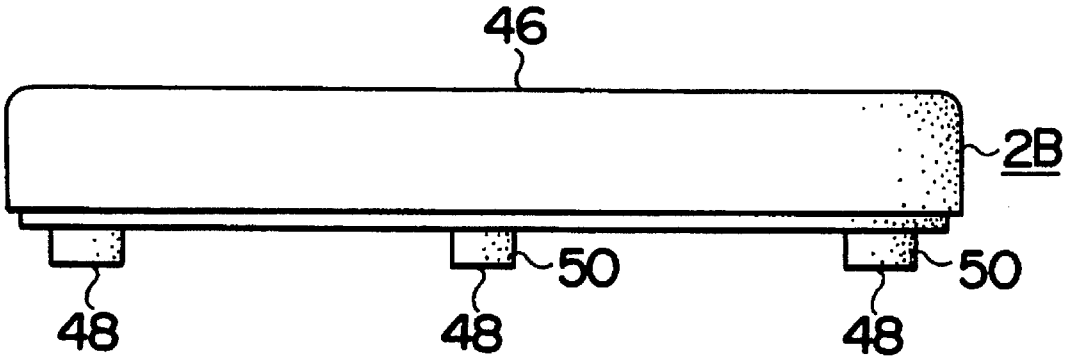
FIG. 2 is a side view showing a casing cap in FIG. 1.
Figure 3:
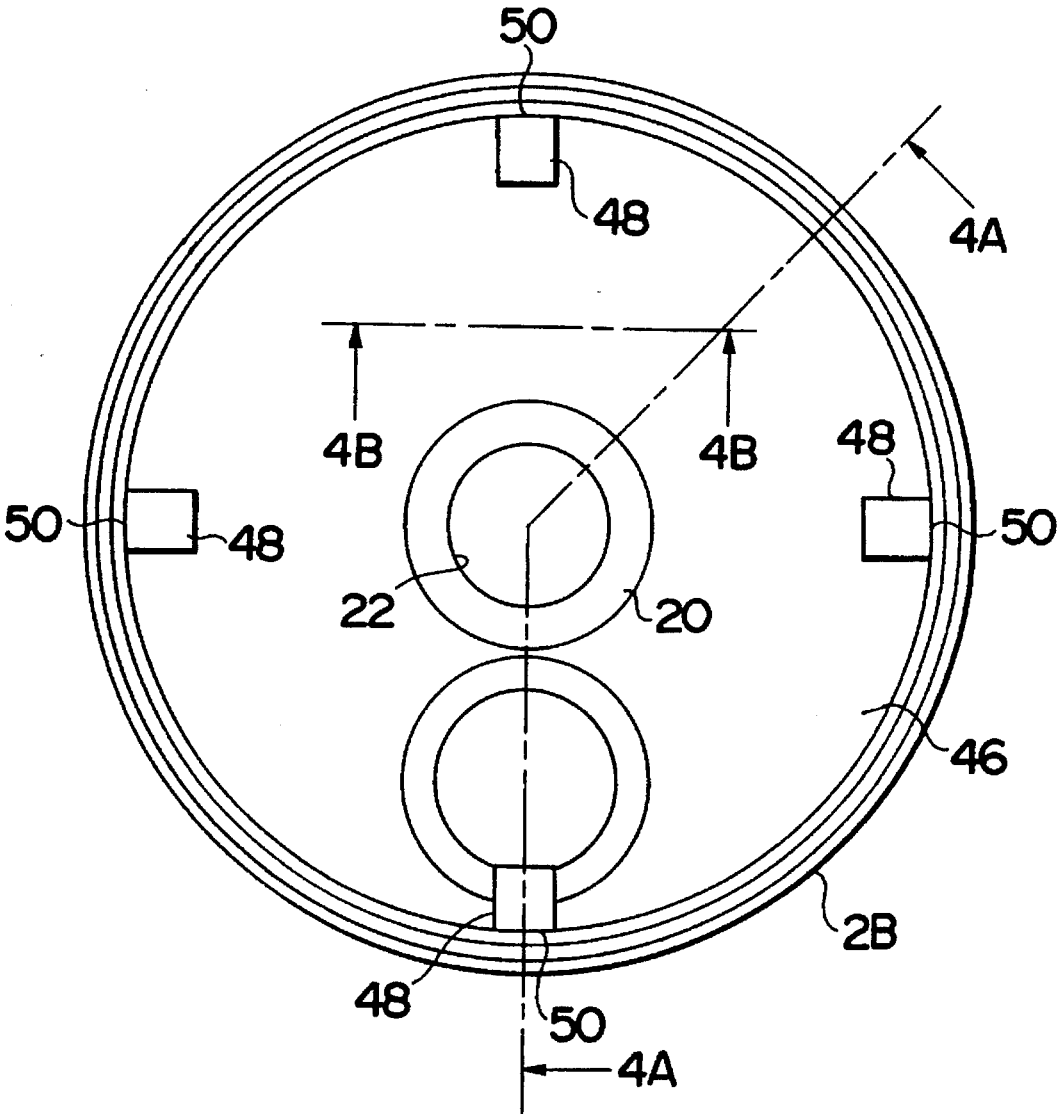
FIG. 3 is a rear view of the casing cap in FIG. 1.

FIG. 1 shows an embodiment of an electroacoustic transducer according to the embodiment of the present invention and FIGS. 2 and 3 show the casing cap thereof.

A housing 2 dividedly composed of a casing body 2A and a casing cap 2B is made of plastic material such as synthetic resins etc. like conventional electroacoustic transducers. The casing body 2A accommodates a magnetic driving portion 4 therein for converting an electric signal supplied thereto into acoustic vibration, and the casing cap 2B closes the opening portion 5 of the casing body 2A to form a resonance chamber 18 which resonates in response to acoustic vibration.

The casing body 2A is a cylinder having a smooth outer surface, and has stages of a stepped supporting portion 12, a projecting guide portion 30 and a concave fixing portion 32 on the inner circumferential surface thereof from the opening portion 5 toward the bottom portion. The thickness of the casing body 2A is designed to be thin at the upper portion to make the opening portion 5 to have a larger diameter and form the stepped supporting portion 12 on the inner circumferential surface of the casing body 2A at about two third (⅔) of that of the casing body 2A in height. The stepped supporting portion 12 is annular corresponding to a diaphragm 14 which is supported thereby. The interval between the stepped supporting portion 12 and the concave fixing portion 32 is set to be slightly larger than the height of a magnet 10 so as to establish a given gap between the magnet 10 and the diaphragm 14. Such an accurate gap setting enables the casing body 2A to be flattened or miniaturized. The projecting guide portion 30 serves as a guiding means for facilitating the insertion of the annular magnet 10 into the casing body 2A and also as a means for positioning the magnet 10 at a given position on a base 34. As a result, the magnet 10 is inserted into a given position in the casing body 2A and is positioned at an optimum position on the base 34 being guided by the projecting guide portion 30. The concave fixing portion 32 formed on the inner circumferential surface of the casing body 2A is a fixing means for the base 34 and corresponds in position and size to a fixing portion 36 of the base 34, the fixing portion 36 being formed thin in the edge portion of the base 34.

The magnetic driving portion 4 is fixed to the casing body 2A by inserting the fixing portion 36 of the base 34 thereof into the concave fixing portion 32 of the casing body 2A. That is, the base 34 can be fixed to the casing body 2A by inserting it when the casing body 2A is formed. A columnar magnetic core 6 projects from the central portion of the base 34, a coil 8 is wound around the magnetic core 6, the annular magnet 10 is arranged to surround the coil 8 and the diaphragm 14 is arranged on the stepped supporting portion 12. The base 34 as well as the diaphragm 14 is made of a metal plate having high permeability and a magnetic piece 16 is attached to the central portion of the diaphragm 14 to increase magnetic flux density and add mass to the diaphragm 14. As a result, the magnetic core 6, the diaphragm 14, the magnetic piece 16, the base 34 and the magnet 10 form a closed magnetic path in the magnetic driving portion 4.

A base plate 38 is provided on the rear surface of the base 34, and through hole portions 40 and 42 are formed in the base 34 and the base plate 38 respectively. The base 34 and the base plate 38 are joined and made one piece with the through hole portions 40 and 42 filled with adhesive 44. The base plate 38 comprises terminals or leads thereon, not shown, through which a driving power which is an electric signal to be converted into a sound is supplied to the coil 8.

The casing cap 2B has a shape of short cylinder having the same diameter as that of the casing body 2A. That is, the casing cap 2B comprises a ceiling portion 46 which closes the opening portion 5 of the casing body 2A to form the resonance chamber 18. A sound emitting cylinder 20 having a sound emitting hole 22 therein for allowing the resonance chamber 18 to communicate with the atmosphere is formed in the ceiling portion 46 and a plurality of projections 48 are formed on the ceiling portion 46 along the inner circumferential surface of the casing cap 2B. According to this embodiment, two pairs of projections 48, each projection being provided opposite to each other around the sound emitting cylinder 20 formed in the central portion of the casing cap 2B, i.e., four projections 48 each substantially having a shape of square pillar are formed therein. Each of the projections 48 comprises a positioning surface 50 which conforms to the inner circumferential surface of the casing cap 2B and also to the inner circumferential surface of the opening portion 5 of the casing body 2A. It is important to conform the positioning surface 50 to the inner circumferential surface of the opening portion 5 to control the positional relation between the casing body 2A and the casing cap 2B and the conformity therebetween enhances positional accuracy. It is possible to temporarily fix the projections 48 to the casing body 2A before welding them by closely connecting them to each other.

Each projection 48 should have a length necessary to be entered into the casing body 2A to restrict the range of movement of the diaphragm 14, i.e., to form a proper gap t between the stepped supporting portion 12 and itself when the casing body 2A and casing cap 2B are connected to each other. The end surface of each projection 48 is made to be flat and parallel to the moving diaphragm 14.

Figure 4A:
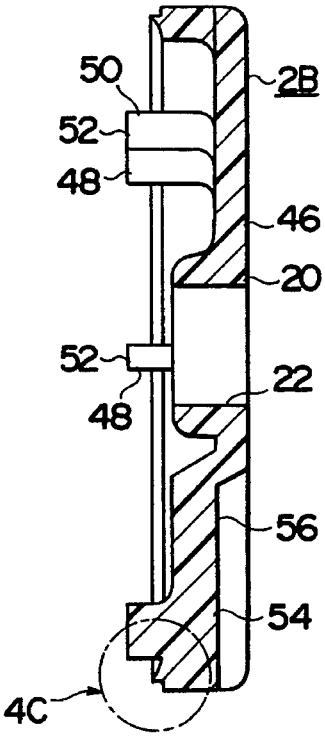
FIG. 4A is a cross-sectional view of the casing cap taken along the line 4A—4A in FIG. 3.

FIG. 4A is a cross-sectional view of the casing cap 2B illustrated in FIG. 3 taken along line 4A—4A, wherein the casing cap 2B comprises a thick portion 54 at a part of the ceiling portion 46 thereof and a concave portion 56 which is U-shaped in a plan view is formed on the outer surface of the thick portion 54 and is provided with a molding gate in the central portion thereof for injecting molding resin therethrough. The figure shows a final product from which the molding gate is removed.

Figure 4B:
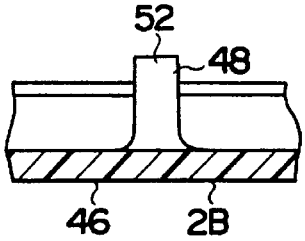
FIG. 4B is a cross-sectional view of the casing cap taken along the line 4B—4B in FIG. 3.

FIG. 4B is a cross-sectional view of the casing cap 2B in FIG. 3 taken along line 4B—4B, wherein the projection 48 which projects from the ceiling portion 46 is a square pillar having a flat end surface 52. The projections 48 can be very slender, the thickness thereof being able to be less than twice as thick as that of the casing cap 2B.

Figure 4C:
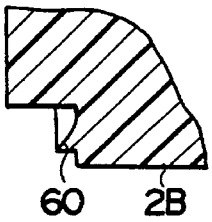
FIG. 4C is an enlarged view of a part 4C of FIG. 4A.
Figure 5:
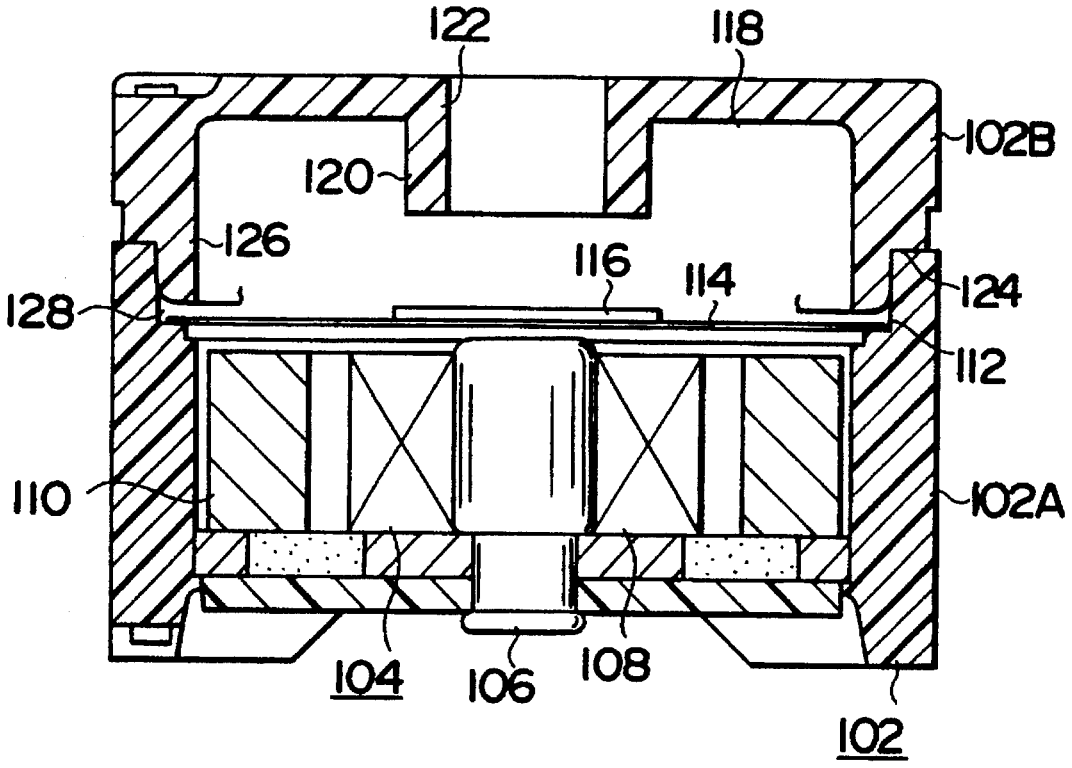
PRIOR ART FIG. 5
FIG. 5 is a longitudinal cross-sectional view of a conventional electroacoustic transducer.

FIG. 4C is an enlarged cross-sectional view of the part 4C of FIG. 4A, which shows a projecting ridge 60 having a V-shaped cross section formed on the end surface of the opening portion of the casing cap 2B at the whole circumference thereof at a position retreating a little from the outer circumference thereof. The projecting ridge 60 is an energy director having a function of fixing the casing cap 2B to the casing body 2A when they are connected to each other by way of ultrasonic welding.

In case of such an electroacoustic transducer, the casing cap 2B is connected to the casing body 2A after the magnetic driving portion 4 is incorporated in the casing body 2A. At that time, the projections 48 of the casing cap 2B are entered into the opening portion 5 of the casing body 2A to position the casing cap 2B relative to the casing body 2A. Since each projection 48 has the positioning surface 50 conforming to the inner circumferential surface of the opening portion 5 of the casing body 2A and moreover a plurality of them are arranged circumferentially, the casing cap 2B is automatically positioned relative to the casing body 2A to complete setting the optimum connecting position therebetween by only entering each projection 48 into the casing body 2A. The positioned casing body 2A and casing cap 2B are made one piece, a finished housing 2 using a fixing means such as ultrasonic welding, adhesive, etc. Since the casing cap 2B is automatically positioned relative to the casing body 2A, it is very easy to position or connect them to each other and the positioning and assembling are improved in accuracy.

Each projection 48 is positioned above the diaphragm 14 which is put in the casing body 2A. Since the length of each projection 48 can be arbitrarily set in the stages of designing and manufacturing, it is possible to restrict the movement of the diaphragm 14 toward the casing cap 2B by each projection 48. When a violent vibration or shock is applied to the electroacoustic transducer, each projection 48 functions as a stopper for the moving diaphragm 14. As a result, the diaphragm 14 is protected from damage or deformation, and prevented from floating off the supporting edge portion and consequently from being deteriorated in characteristic so that the electroacoustic transducer is prevented from being reduced in reliability.

Referring to the restriction of the moving range of the diaphragm 14, the projections 48 have the end surfaces 52 parallel to the diaphragm 14 and moreover they are circumferentially formed above the edge of the diaphragm 14 at a given interval, so that the moving diaphragm 14 is brought into contact with the projections 48 gently and protected from shocks applied locally.

The slender projections 48 formed as a means for positioning the casing cap 2B relative to the casing body 2A and restricting the moving range of the diaphragm 14 as described above can sufficiently perform their function. In other words, the projections 48 occupies space only a little in the resonance chamber 18. As a result, the resonance chamber 18 formed by the casing body 2A and casing cap 2B can be designed regardless of the projections 48, so that a sufficient and large capacity can be assigned to the resonance chamber 18 with increased degree of freedom. Accordingly, the ratio of the resonance chamber 18 to the housing 2 in capacity can be set large so that it is possible to miniaturize and flatten the housing 2 and consequently miniaturize the electroacoustic transducer having the same capacity of the resonance chamber 18. Since the enlarged capacity of the resonance chamber 18 enables enlarging the sound emitting hole 22, the characteristic of sound pressure can be improved such as reinforcing the sound pressure etc.

The modifications of the electroacoustic transducer according to the present invention will be described hereinafter.

a. Although the projections 48 are projected from the ceiling portion 46 of the casing cap 2B according to this embodiment, they may be projected from the inner circumferential surface of the casing cap 2B.

b. The projections 48 may be projected from the outer circumferential surface of the casing cap 2B.

c. Although four projections 48 are formed in this embodiment, two, three, or more than four projections 48 may be formed at a given interval.

d. Although the connecting surfaces of the casing body 2A and casing cap 2B are flat according to the above embodiment, arbitrary concave portions, resin pools, etc. may be formed therein depending on the fixing means.

Although the characteristic of the present invention has been described in its preferred embodiment, it is not limited to the embodiment or modifications set forth above but may include various modifications having similar objects and functions.

What is claimed is:

1. An electroacoustic transducer for converting an electric signal into an oscillating magnetic field which vibrates a diaphragm so as to convert said oscillating field to an acoustic vibration, said electroacoustic transducer comprising:

a cylindrical body made of synthetic resin and having a stepped supporting portion formed on an inner circumferential surface thereof;

a magnetic driving portion located in said casing body for converting said electric signal into said oscillating magnetic field;

said magnetic driving portion having (a) a base made of magnetic material and fixed to said casing body so as to close an opening portion of said casing body, at the rear side thereof, when said casing body is formed;

(b) a magnetic core mounted on a center of said base;

(c) a coil wound around said magnetic core for receiving said electric signal from an external device; and (d) a magnet having an annular body for surrounding said coil;

said diaphragm placed on said stepped supporting portion of said casing body and radially restricted thereby;

said diaphragm forming a gap between itself and an end surface of said magnetic core, and forming a closed magnetic path together with said core, base and magnet, and vibrating in response to said oscillating magnetic field produced in said magnetic driving portion;

a casing cap forming an outer casing together with said casing body for closing said opening of said casing body;

said casing cap made of synthetic resin and forming a resonance space at the front side of said diaphragm, and including a sound emitting hole for opening said resonance space to the atmosphere;

a plurality of projections formed in and integrated with said casing cap, each projection having an outer circumferential surface conforming to an inner circumferential surface of said casing body at said opening portion thereof, wherein said casing body and casing cap are aligned with each other when said projections enter said opening portion of said casing body, and end surfaces of said projections forming a gap with a peripheral section of an upper surface of said diaphragm for limiting allowable axial movement range of said diaphragm.

2. An electroacoustic transducer according to claim 1, wherein said projections are arranged along an edge portion of said diaphragm at a given interval, and said end surfaces of said projections are set to be parallel with said diaphragm.

3. An electroacoustic transducer according to claim 1, wherein said diaphragm has a magnetic piece mounted thereon to add mass thereto.

4. An electroacoustic transducer according to claim 1, further including a projecting guide portion projecting radially inward from said inner circumferential surface of said casing body to said base, said projecting guide portion positioning said magnet at a given position on said base.

* * * * *